United States Patent [19]

Mayhall, Jr. et al.

[11] Patent Number: 4,597,516

[45] Date of Patent: Jul. 1, 1986

[54] WEB FEEDER APPARATUS

[76] Inventors: Riley H. Mayhall, Jr., 14130 Columbia Rd., Burtonsville, Md. 20730; Andrew Zudal, 4140 Mt. Olney La., Olney, Md. 20832

[21] Appl. No.: 650,994

[22] Filed: Sep. 17, 1984

Related U.S. Application Data

[63] Continuation-in-part of Ser. No. 486,451, Apr. 20, 1983, abandoned, which is a continuation of Ser. No. 185,797, Sep. 10, 1980, abandoned.

[51] Int. Cl.[4] ..... B65H 20/02

[52] U.S. Cl. ..... 226/154; 226/34; 226/171; 226/174; 226/181; 226/190; 53/211

[58] Field of Search ..... 226/143, 25, 34, 35, 226/80, 89, 90, 154, 155, 170, 171, 172, 174, 176, 181, 186, 187, 190, 193, 194; 53/211, 399, 441, 587, 588

[56] References Cited

U.S. PATENT DOCUMENTS

| | | | |
|---|---|---|---|
| 1,718,146 | 6/1929 | Hartman | 226/90 |
| 2,523,387 | 9/1950 | Natzke | 226/187 X |
| 2,990,092 | 6/1961 | Begun et al. | 226/176 |
| 3,724,945 | 4/1973 | Masiello | 226/35 X |
| 3,838,519 | 10/1974 | Chick | 226/90 X |
| 4,050,221 | 9/1977 | Lancaster, III et al. | 53/211 |
| 4,053,092 | 10/1977 | Edwards | 226/90 |
| 4,119,256 | 10/1978 | Vogtmann et al. | 226/187 X |
| 4,283,903 | 8/1981 | Mayhall et al. | 53/287 |

*Primary Examiner*—Stanley N. Gilreath
*Attorney, Agent, or Firm*—Wegner & Bretschneider

[57] ABSTRACT

An apparatus and method for supplying thin film plastic web materials to a wrapper machine as shown and described. This apparatus includes feed stripper which assures the separation of the web material from the apparatus. The feed stripper includes a clamp feed and either a belt roller for stripping or a stripper bar for stripping the film off. An anti-static bar is used to eliminate static electricity on the web material.

17 Claims, 14 Drawing Figures

WEB FEEDER APPARATUS

This application is a continuation-in-part application of U.S. application Ser. No. 486,451, filed Apr. 20, 1983, now abandoned, and which is a continuation of U.S. Ser. No. 185,797, filed Sept. 10, 1980, now abandoned.

BACKGROUND OF THE INVENTION

In prior art packaging apparatus requiring the handling of varying lengths of flexible film at varying rates, film control is a problem. When a loose end of flexible film web material is attached to an irregular package and pulled from a web supply roll while wrapping a irregular package at varying speeds, pulsations are produced which vary the web tension and cause repeated web failures. This results in low productivity. Another problem encountered in prior apparatus is static electricity which causes failures during packaging operations and resulting down time. A further problem is the difficulty of feeding out of a predetermined length of a loose portion of web material in a suitable form for attachment to the next package to be wrapped. In prior apparatus there was difficulty with the deacceleration and the holding of tension in a web material after pull-through during wrapping and prior to the controlled parting or severing of the web material from a wrapped package.

This invention provides solutions to the problems and inadequacies set forth above.

SUMMARY OF THE INVENTION

This invention eliminates many of the expensive, complex and unreliable parts associated with known web feeding apparatus. This invention provides for high speed pass through of web material with a shock-absorbing pivoted dancer-idler system, a controllable web clamping system, and a controllable web feed-out system. Further, this invention positively feeds out a predetermined length of a loose end portion of web material on command and clamps web material for subsequent operations.

A better understanding of the preferred embodiment and alternative embodiments of the invention will be achieved when the following written description is considered in conjunction with the appended drawings.

OBJECTIVES AND ADVANTAGES

It is an object of this invention to provide a simplified means and a completely intergrated system for web feeding and control of said web for subsequent operations.

A further object is to eliminate costly complex and unreliable systems used heretofore in web feeding and the controlling thereof.

A further object is to provide a shock absorbing means for high speed web feed-out as required.

A further object is to provide for positioning and clamping of web as required.

A further object is to provide an increased production rate due to the reduced number of operations, response time, complexity of controls, consumption of energy, and provide a complete intergratable web feeder apparatus.

It is a further object to provide for optional right and left hand feed configurations by mere assembly procedures.

The main advantage of this invention is the reliability of web feeding and controlling of web under all conditions.

A further advantage is the increased production rate which is achieved through the simplified operation and system control. High rates of production are required in modern automatic processing line operations.

A further advantage is that the design permits the use of identical parts in right and left handed machines.

Figure 1:
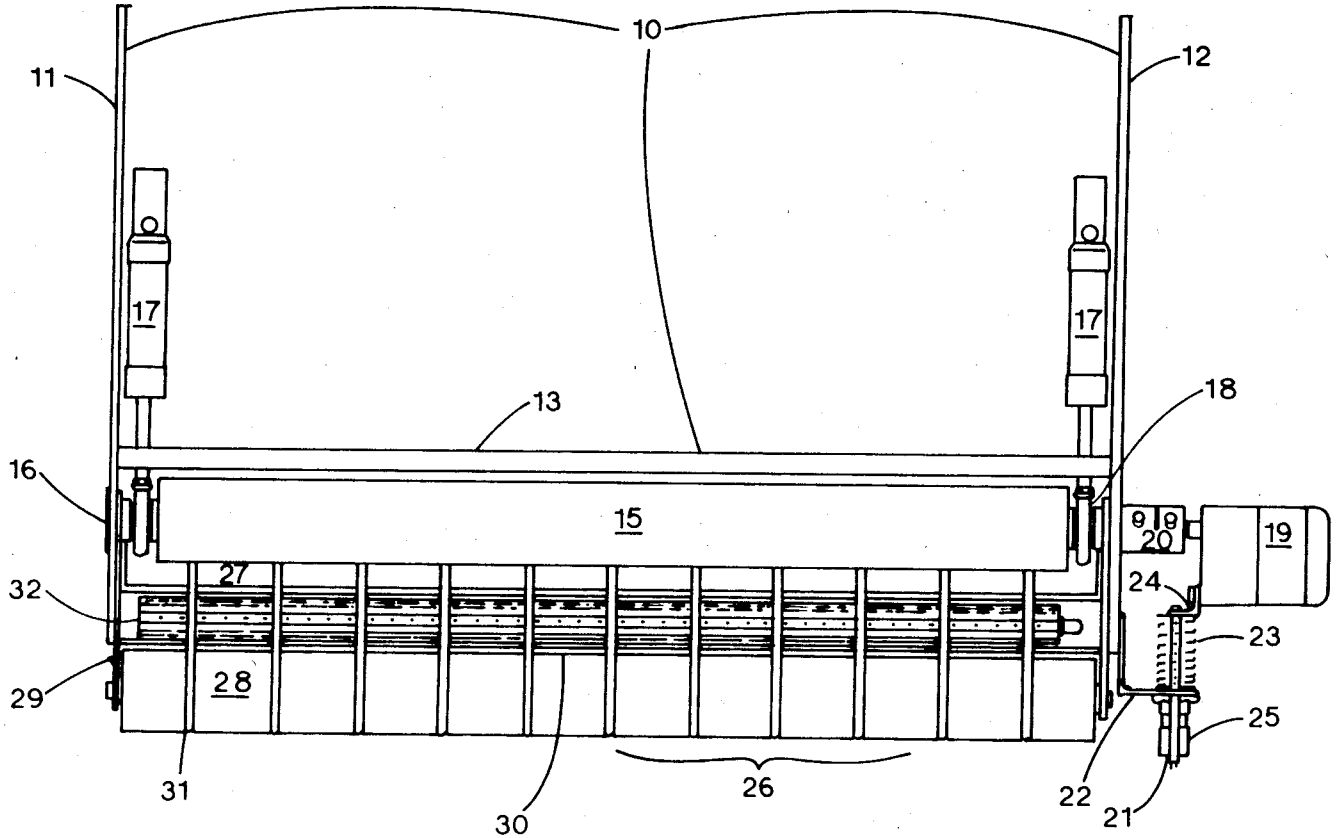
FIG. 1 is a front elevation view of the web feeder apparatus.
Figure 2:
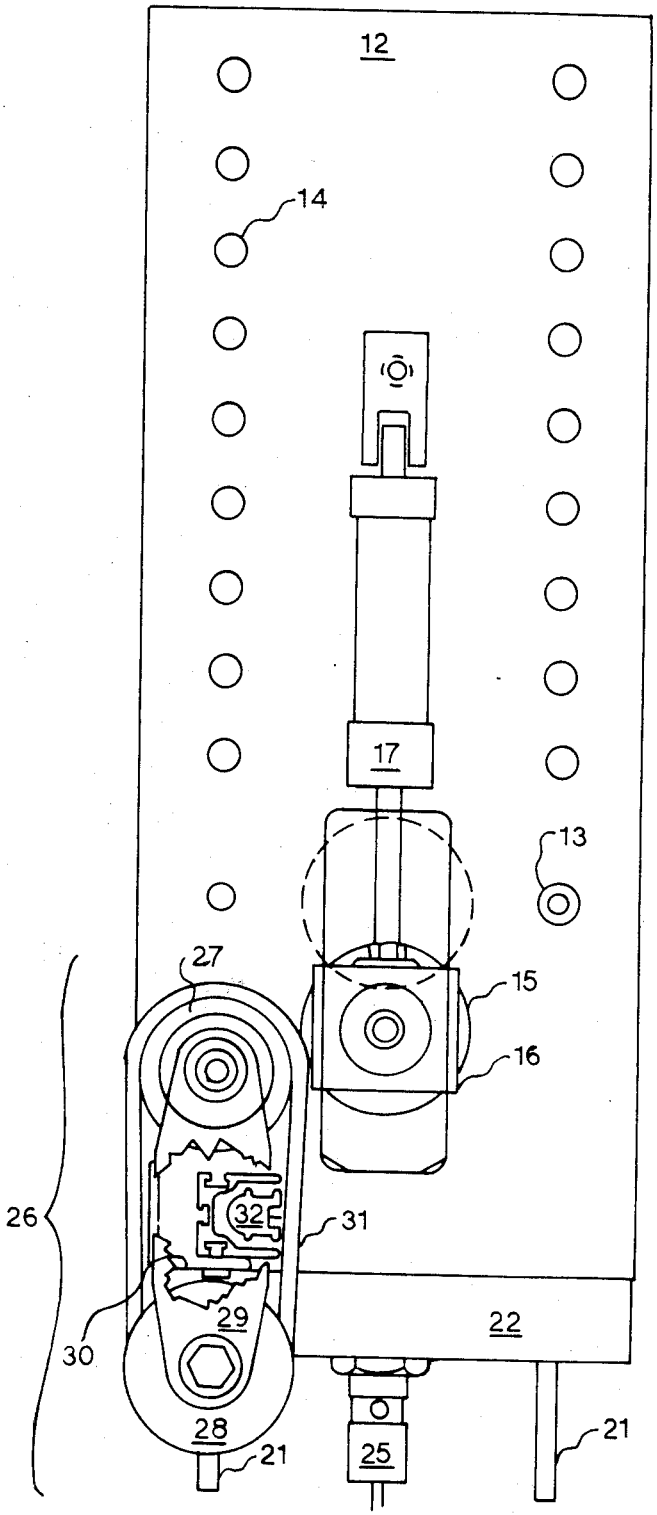
FIG. 2 is a left end view with left end plate removed.
Figure 4:
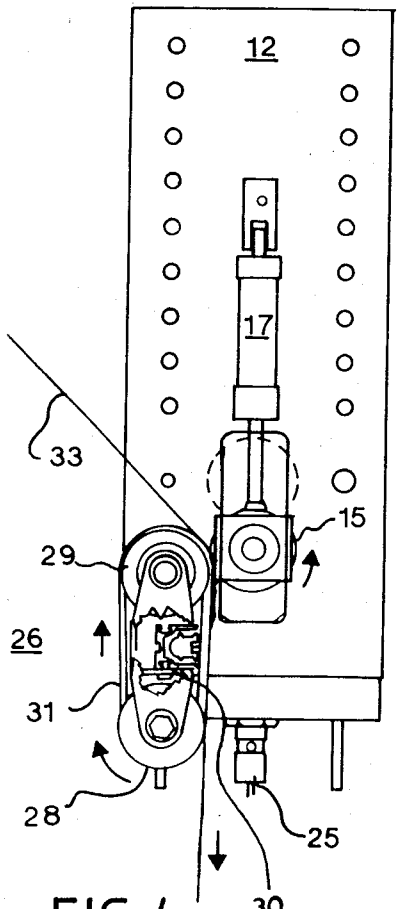
FIG. 4 is a schmatic representation showing the left end view with the loose portion of web material fed out and clamped.

Attention is initially invited to FIGS. 1 and 2 which show the assembly of the apparatus. The frame means 10 is comprised of two identical end plates 11 and 12 and tie bar 13. The apparatus assembly will be mounted to a user machine using the series of mounting holes 14 shown in FIG. 2. The clamp-feed roller 15 is rotably supported by slider bearing blocks 16 at each end plate 11 and 12 which provides slots for receiprocating motion of the clamp-feed roller 15 toward and away from the compression-idler tractor roll assembly 26. A pair of fluid power actuators 17 are rotably connected to the clamp-feed roller 15 one at each end for positioning in a selfaligning predetermined manner by shperical rod eyes 18. A brake-motor 19 which can be an electrically or fluid power or other rotating torque producing means is connected to the shaft end of clamp-feed roller 15 by clamp coupling 20. The brake motor 19 is prevented from rotating by pins 21 slidingly retained by torque angle 22 affixed to end plate 12. A spring means 23 is positioned between torque angle 22 and pin support 24 to prevent shock and unbalance. A proximity sensor 25 is provided to indicate position of clamp-feed roller 15 providing for automatic control. The length of web material 33 (FIG. 3) fed out will be determined by using the proximity sensor 25 to indicate that clamp-feed roller 15 has formed a nip with compression-roller 27 (FIG. 4) is in feed position and either a timed period of actuation of brake-motor 19 or by using a shaft revolution counter controller means. The compression-idler tractor roll assembly 26 is comprised of compression roller 27, idler roller 28, side plates 29, tie bar 30, feed-stripper belts 31, and anti-static bar 32. The compression roller 27 provides locating grooves for feed stripper belts 31 of a depth such as to provide a compressible portion of each feed-stripper belt above the surface of the compression roller 27. It must be understood that the feed-stripper belts 31 shown are a round cross-section of a resilient material but could be of any other cross-section. The idler roller 28 provides locating grooves for feed-stripper belts 31 of a depth greater than the feed-stripper belts 31 for thickness so as to strip the web material from the belts during the feeding operation to user device as shown in FIG. 4. The compression roller 27 and idler roller 28 are equipped with anti-friction bearings at each end and a thru shfat with tapped holes at each shaft end for mounting. The end plates 29 provide the idler roller 28 shaft fastening holes and pivoting bearing connection to the compression roller 27 shaft so that the compression-idler tractor roll assembly 26 pivots around the compression roller 27 FIGS. 4 and 5 shaft center with respect to forces imparted by web material 33 thus providing an idler dancer-shock absorbing action. In certain applications of this web feeder apparatus the compression-idler tractor roll assembly 26 will be provided with a spring control means and positive stops particularly where gravity forces are not sufficient to provide reliability. The anti-static bar 32 is a commercially available item such as manufactured by the Chapman Corporation and is used to create a field of ionized air which the web material 33 passes thru and receives a balancing charge eliminating static problems with respect to web control in most applications. Additional anti-static bars of other manufacture can be mounted in close proximity to web material 33 path when required to perform the same function.

Figure 5:
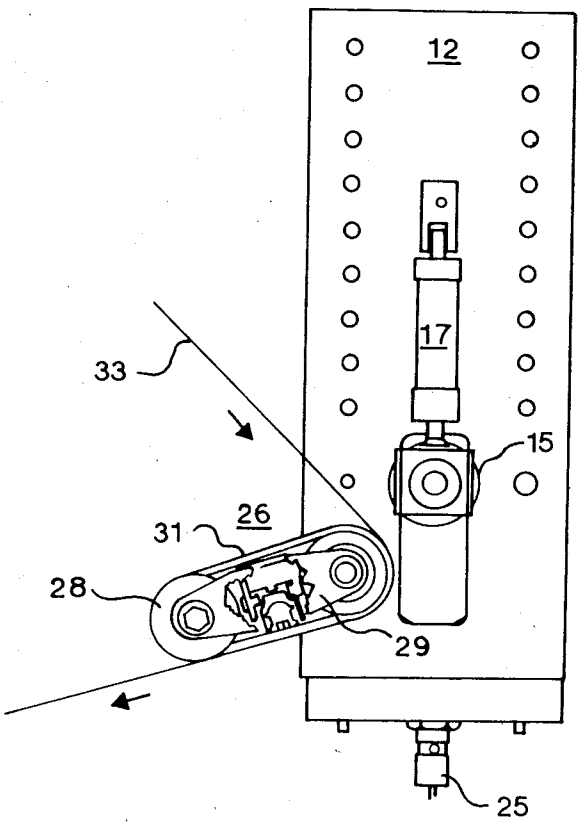
FIG. 5 is a schematic representation of the left end showing the unclamped position for through-feeding of web material and the dancer-shock absorbing action.
Figure 3:
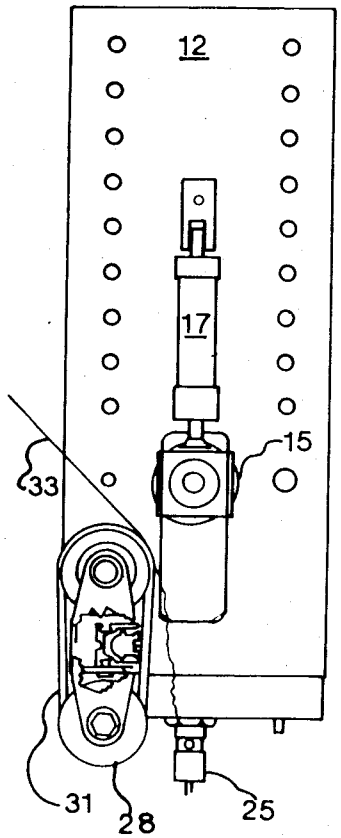
FIG. 3 is a schematic representation of the left end view showing the unclamped postion for threading web material.

The mode of operation and function of the various parts can best be seen in FIG. 1, FIG. 2, and schematic diagrams FIGS. 3, 4, 5, and illustrations 11, 12, 13, 14. In FIG. 3 the clamp-feed roller 15 is positioned away from compression roller 27 to allow web material 33 installation and threading and/or pulling thru to user machine. In FIG. 4 is shown the web material 33 clamped between clamp-feed roller 15 and compression roller 27 so that when brake-motor 19 is actuated in a counterclockwise direction for a predetermined number of revolutions a length of web material 33 will be fed out and conveyed by feed-stripper belts 31 thru a field of ionized air produced by anti-static bar 32. In FIG. 5 is shown web material 33 being pulled from a supply roll and passed through to user device under tension sufficient to pivot the compression-idler tractor roll assembly 26 overcoming either gravity forces or when required a spring assist means. It must be understood in some applications additional weight can be added to compression-idler tractor roll assembly 26 to provide the increased dampening required or an adjustable spring assist means could also be added if required. It also must be understood that a proximity control sensor or other type system will be added when required to detect the position of the pivoted compression-idler tractor roll assembly 26 and thus provide a signal on relaxation of web material 33 tension as user demand decreases and when the web breakes or pulls out.

Figures 8, 9, 10:
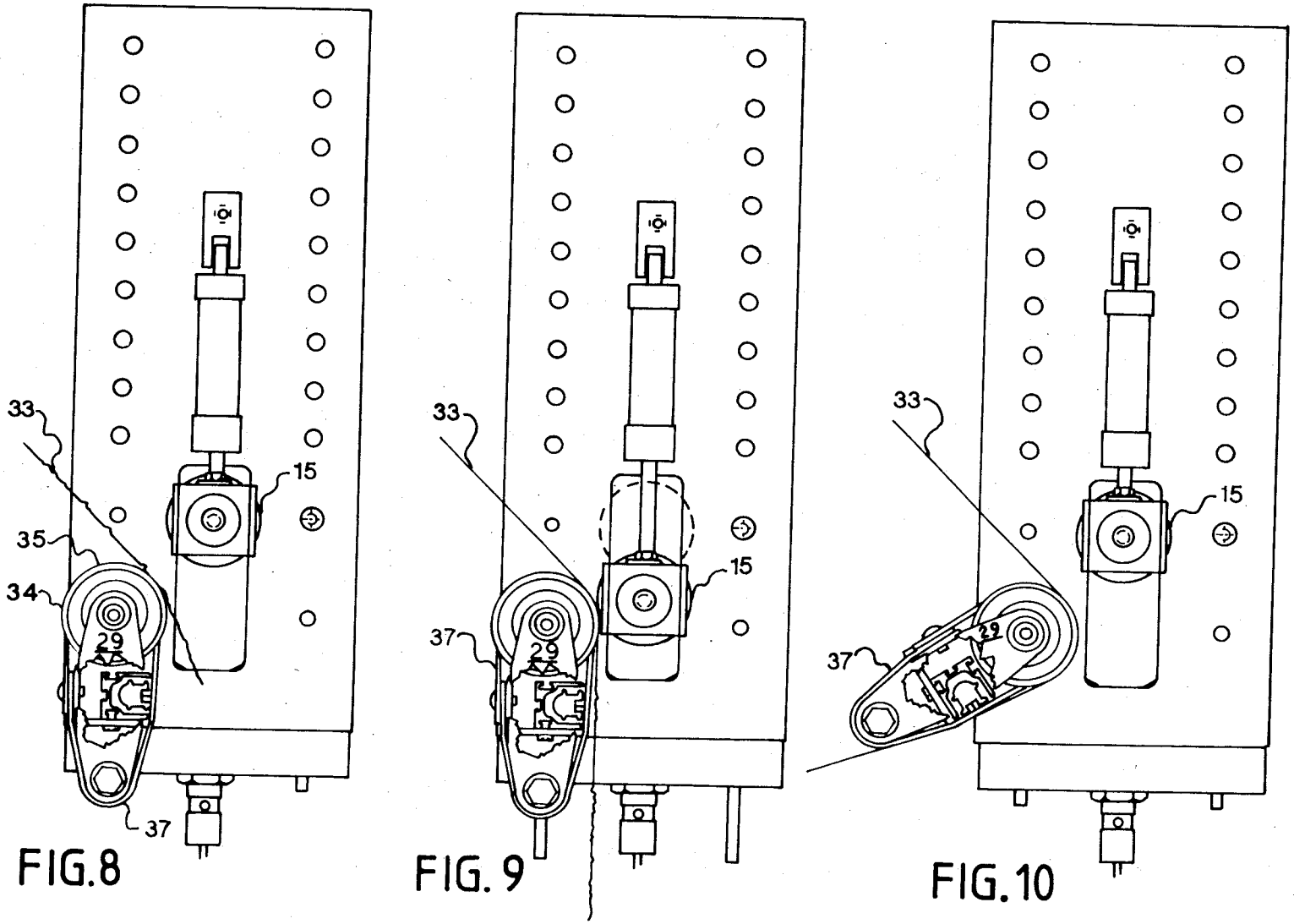
FIG. 8 is a left end view of the alternative embodiment of FIG. 6 showing the unclamped position for threading web material.
FIG. 9 is a schematic representation of the alternative embodiment of FIG. 6 showing the left end view with the loose portion of web material fed-out and clamped.
FIG. 10 is a schematic representation of the alternative embodiment of FIG. 6 showing left end view with unclamped position for through-feeding of web material and the pivoted idler shock absorbing action.

In FIGS. 6, 7, 8, 9, and 10 is shown an alternative embodiment that differs from FIGS. 1, 2, 3, 4, and 5 only in that the compression-idler tractor roll assembly 26 is shown with deletion of compression roller 27, idler roller 28 and feed-stripper belt 31 and the addition of compression roller 34 carrying compression-drive bands 35 and support-tie bar 36 which supports stripper guides 37 that are fastened by rivet 38 to tie bar 30. The stripper guides 37 fully encircle compression roller 34 and are inside the compression-drive bands 35 with their outside surfaces below the pheriphery of compression roller 34 within the web material 33 path so as to provide for guiding and stripping of web material 33 from compression-drive bands 35 after web material 33 passes thru clamp-feed roller 15 and compression-drive bands 35 on feed-out operation as seen in FIG. 8.

Figure 6:
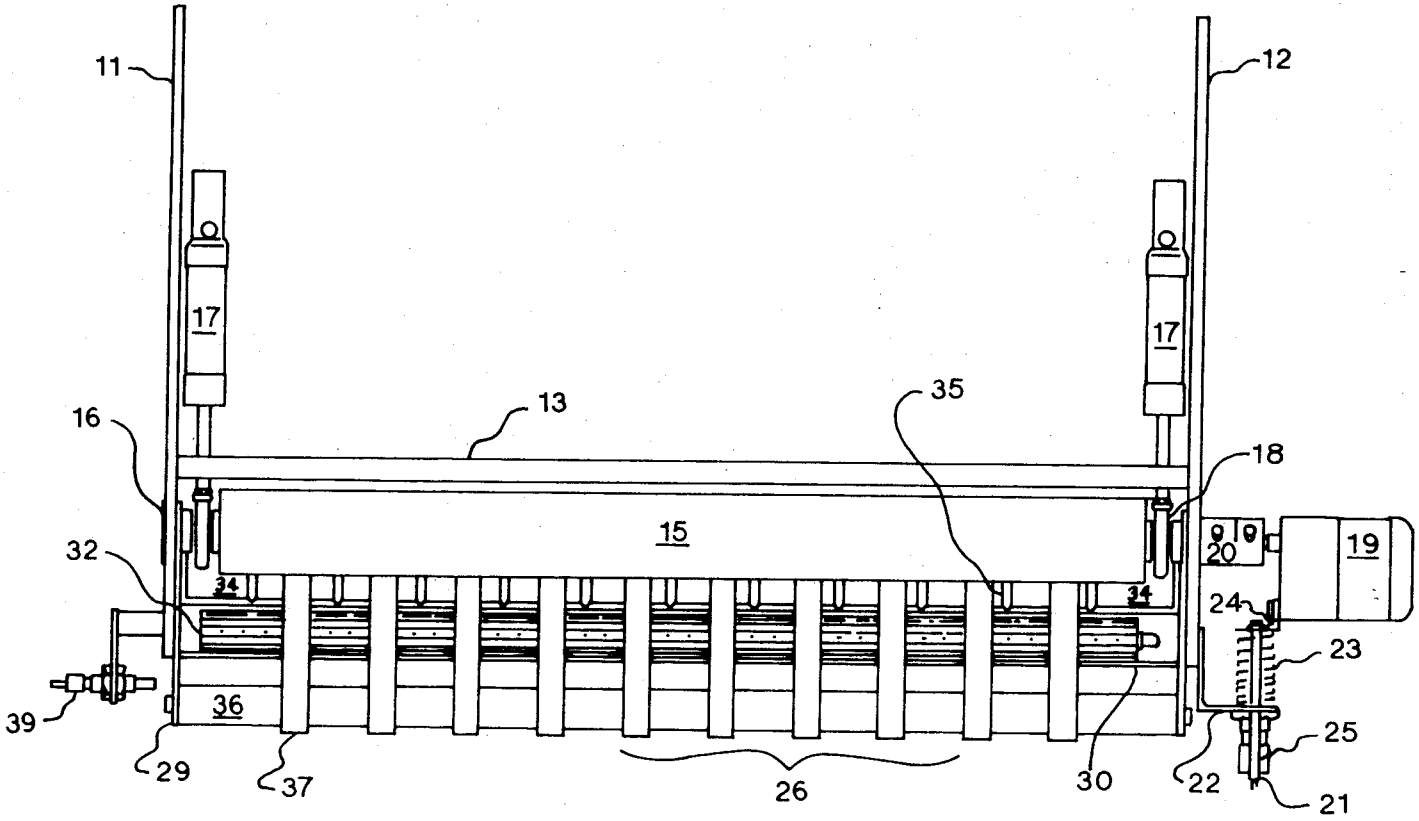
FIG. 6 is shown an alternative embodiment front elevation view employing the use of static strippers and a compression roller.
Figure 7:
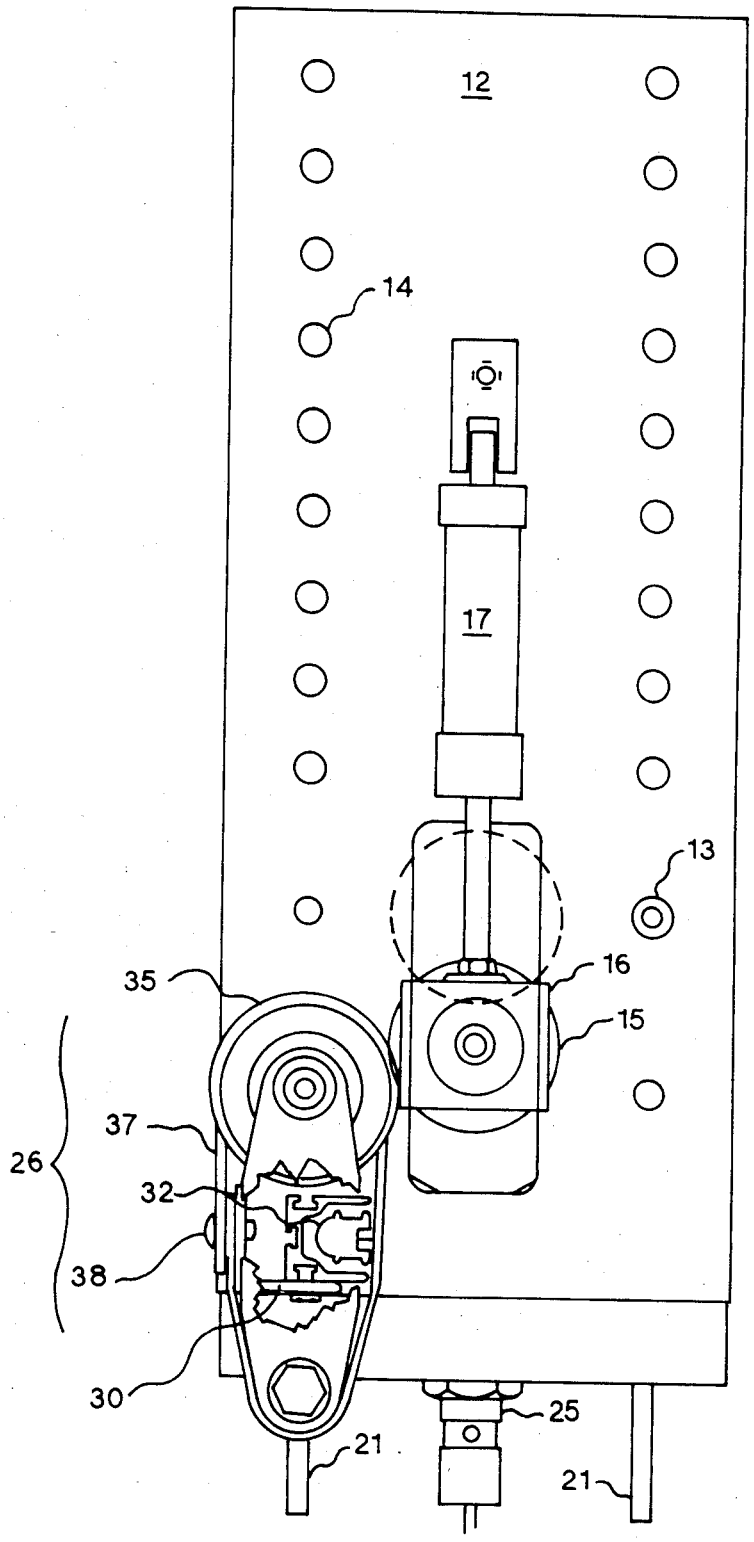
FIG. 7 is a left end view of the aternative embodiment of FIG. 6 with left end plate removed.

In FIG. 6 are shown the additional parts described above with the addition of position sensor 39 which detects the position of compression-idler tractor roll assembly 26 as required on relaxation of tension in web material 33.

In FIGS. 8, 9, and 10 of the aternative embodiment of FIG. 6 is shown a schematic diagram depicting the mode of operations and function of the various parts. The reader is referred to the above description of FIGS. 3, 4, and 5 which similarly applies to FIGS. 8, 9, and 10 along with the above description of FIGS. 6 and 7.

BRIEF DESCRIPTION OF OPERATION

A description of one complete cycle of operation of this apparatus is herein provided.

Attention is invited to FIGS. 11, 12, 13, and 14, which are schematic illustrations of functions of this apparatus when associated with a package wrapping machine such as disclosed in U.S. patent application Ser. No. 06/165,770, filed on July 3, 1980 and continuation application Ser. No. 06/521,023, filed Aug. 9, 1983.

Figure 12:
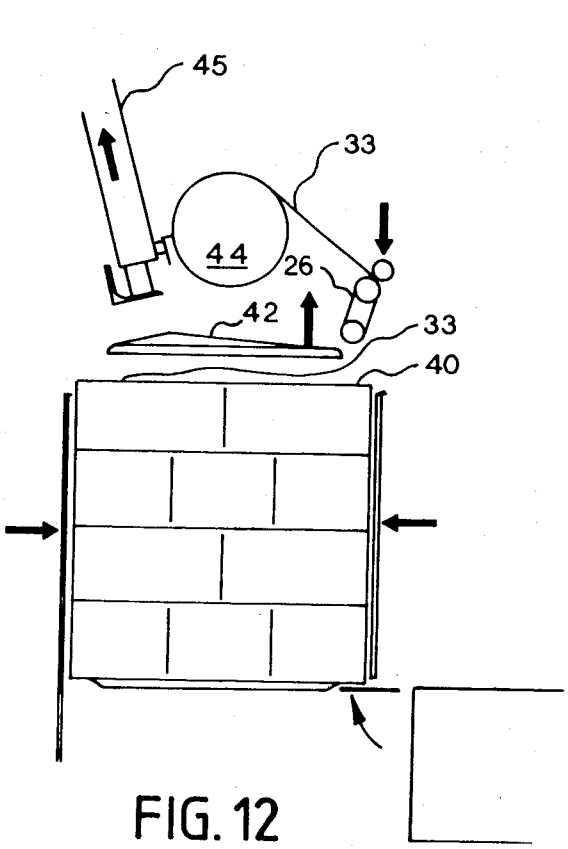
FIG. 12 is a schematic illustration showing the left end view of this web feeder apparatus interfaced with a package wrapping machine with the severed loose end portion of the web material between the upper movable clamp of the wrapping machine and the assemblage of package components resting on the lower fixed clamp of the wrapping machine after insertion of the assemblage of package components had carried the severed loose end portion into the shown position prior to clamping and wrapping operations.
Figure 11:
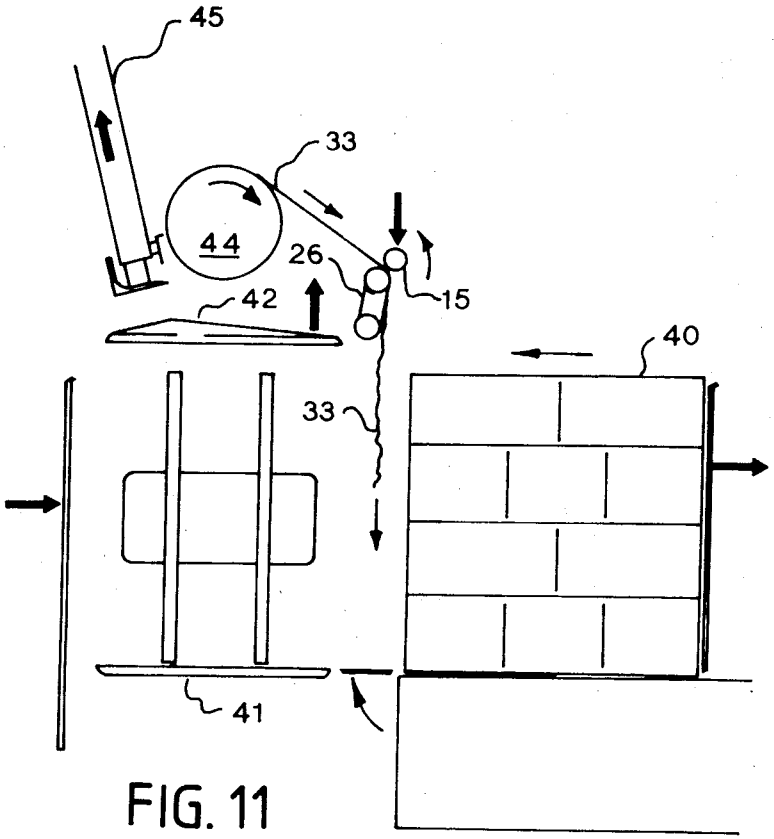
FIG. 11 is a schematic illustration showing the left end view of this web feeder apparatus interfaced with a package wrapping machine with the severed loose end portion of the web material hanging downwardly across the insertion path of an assemblage of package components prior to infeed to wrapping station.
Figure 14:
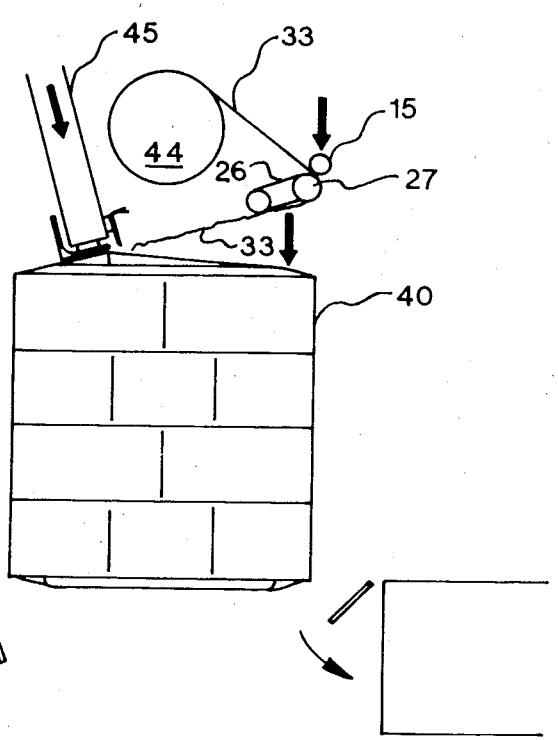
FIG. 14 is a schematic illustration showing the left end view of this web feeder apparatus interfaced with a package wrapping machine showing the loose portion of web material being severed from the wrapped package with the clamp-feed roller extended to form a nip with the compression-idler tractor roll.
Figure 13:
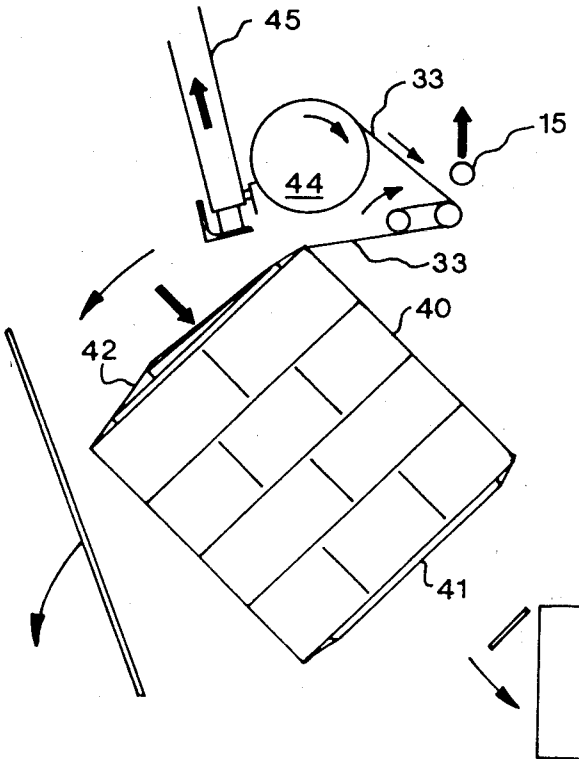
FIG. 13 is a schematic illustration showing the left end view of this web feeder apparatus interfaced with a package clamped together with the package and being rotated to wrap package with clamp-feed roller retracted to permit free through-feed of web material.

Attention is initially invited to FIG. 11 which shows a left end view and configuration of the various assemblies prior to package 40 being inserted between fixed package clamp 41 and movable clamp 42 while clamp-feed roller 15 is in the nip position with compression-idler tractor roll assembly 26 power feeds out a predetermined lenght of web material 33 pulled from supply roll 44 between and in path of package 40 and clamping means 41 and 42. The length of the loose end portion of web material fed out can be determined by such as timed motor actuation period or a shaft revolution counter or other sensor means and any method used will provide a signal that the predetermined length of web material has been fed out. On completion of the web material 33 feed-out a signal is emitted actuating the movement of package 40 from right to left carrying the loose web material 33 underneath of movable clamp 42 and betweeen package 40 and movable clamp 42 while the clamp-feed roller 15 is in a selectively adjustable braked mode. On completion of package 40 insertion movable clamp 42 closes compressing loose portion of web material 33 between package 40 supported by fixed clamp 41 and movable clamp 42 thus completing the attachment of web material to package 40. On completion of the attachment of web material 33 to package 40 clamp-feed roller 15 is moved away from the nip position (FIG. 3) with compression-idler tractor roll assembly 26 and changing status of proximity sensor 25 (FIGS. 1, 2 and 3) actuates rotation of clamping means 41 and 42 (FIG. 13) and package 40 wrapping web material around same. During this wrapping operation tension can be applied which will produce pivoting of compression-idler tractor roll assembly 26 around center of compression roller 27 shown in FIG. 13 the pivoting action will fluctuate with respect to pulsations in speed and tension imparted to web material 33 by either controlled braking of the supply roll or compression-idler roller 27. The wrapping operation, position sensor 39 (FIG. 6) can detect position of compression-idler tractor roll assembly 26 and when desired vary web material 33 tension in direct relation to braking applied accordingly. On completion of a predetermined number of wraps a signal from wrapping counter actuates the fluid power actuators 17 moving the clamp roller 15 into nip position (FIG. 14) with compression-idler tractor roll assembly 26. The nip provides braking and holding of tensioned web material 43 when the rotary wrapping cycle is completed. The nip also provides braking during a smooth down or bonding of web material 33 to the layer underneath and during parting or severing of web material 33 from the package. Severing is provided by the downward movement of the smooth-down-cut-off assembly 45 (FIG. 12). After the parting or severing of web material 33 from package the weighted or spring loaded compression-idler tractor roll assembly 26 pivots to a positive stop or downward position absorbing the recoil of the tensioned web material 33 preventing a bunching or wrinkling of web material. The feed-out cycle is restarted on signal from position sensor 39 or other sensor means employed when pivoted compression-idler tractor roll assembly 26 reaches home position. This completes one cycle in this particular application.

In other applications this apparatus would be controlled differently. Predetermined nip pressures during each phase of the cycle may be accomplished by varying the pressure in fluid power actuators 17. Varying control may be provided for the braking forces applied to clamp-feed roller 15 and/or varying braking forces and/or driving forces applied to compression roller 27. Clamp-feed roller 15 may be driven at a predetermined speed while driving compression roller 27 is driven at a different speed. Control may be by pivoted position of compression-idler tractor roll assembly 26 and position sensors 39 or other controller means.

Variations in the construction and operation of the described embodiments can be envisioned. One example has been described herein when this invention is interfaced with a well-known means for unitizing bundles of items. Such variations, embodying some or all of the novel featues herein disclosed, are comprehended, and we do not intend to be limited only to the specific embodiment herein described, but rather, we intend to be limited only by our disclosure taken as a whole, including the appended claims.

We claim:

1. An apparatus for feeding thin flexible plastic film web material from a supply roll to a package wrapping apparatus of a package wrapping machine comprising in combination a driven clamp feed roller;

a compression idler tractor roll assembly for engaging said clamp feed roller to form a nip between said roller and assembly for holding and feeding said web material;

said compression idler tractor roll assembly including one or more feed stripper belts for conveying and guiding a length of web material from said nip; and meas for moving said clamp feed roller into and out of engagement with said compression idler tractor roll assembly, whereby a loose portion of said web material may be fed to said package wrapping apparatus.

2. The apparatus in accordance with the claim 1, wherein said feed stripper belts are compressible.

3. The apparatus in accordance with claim 1, wherein said clamp feed roller provides power to said feed stripper belts.

4. The apparatus of claim 3 further including means for turning said clamp feed roller a predetermined amount whereby a length of said web material which comprises said loose portion extends a predetermined distance beyond said apparatus for feeding.

5. The apparatus of claim 4, wherein said means for turning turns said clamp feed roller a predetermined number of revolutions.

6. The apparatus of claim 4, wherein said means for turning turns said clamp feed roller for a predetermined length of time.

7. The apparatus of claim 1, wherein said compression idler tractor roll assembly further includes an anti-static means for eliminating static electricity in the web material.

8. The apparatus of claim 1, wherein said compression idler tractor roll assembly includes a compression roller and an idler roller and said feed stripper belts move around said idler roller and said compression roller.

9. The apparatus of claim 1, wherein said compression idler tractor roll assembly means includes at least one stripper guide which lies below said feed stripper belts and which extends beyond said compression roller and feed stripper belts in the direction of said length of said web material.

10. The apparatus of claim 8, further including grooves on said idler roller in which said belts ride and wherein said grooves are deeper than the thickness of said belts whereby said idler roller extends beyond said belts and provides a surface which strips said web from said apparatus for feeding.

11. The apparatus of claim 1, wherein said clamp feed roller is mounted on a slide bearing block and is actuated by a linear actuator.

12. The apparatus of claim 1, wherein said compression idler tractor roll assembly engages said web material when said web is pulled from said apparatus for feeding and is pivotally mounted to provide dancer idler action for said web.

13. The apparatus of claim 12, wherein said dancer idler action is resisted by a spring force.

14. The apparatus of claim 13, wherein said dancer idler action is resisted by the force of gravity on the compression idler tractor assembly.

15. The apparatus of claim 1, further including means for sensing the presence of said clamp feed roller in engagement with said compression idler tractor roll assembly.

16. The apparatus of claim 12, further including a sensor for determining whether said compression idler tractor roll assembly is pivoted to a predetermined amount.

17. The apparatus of claim 1, including a controllable brake motor for controlling the braking and rotation of said clamp feed roller.

* * * * *